United States Patent [19]

Duin

[11] Patent Number: 4,754,250

[45] Date of Patent: Jun. 28, 1988

[54] HOLDING DEVICE FOR TOROIDAL CORES PROVIDED WITH WINDINGS

[75] Inventor: Albert Duin, Grobenzell, Fed. Rep. of Germany

[73] Assignee: Firma Wilhelm Sedlbauer GmbH, Fed. Rep. of Germany

[21] Appl. No.: 29,396

[22] Filed: Mar. 23, 1987

Related U.S. Application Data

[63] Continuation of Ser. No. 763,890, Aug. 5, 1985, abandoned, which is a continuation of Ser. No. 482,491, Apr. 6, 1983, abandoned.

[51] Int. Cl.[4] ..... H01F 15/02

[52] U.S. Cl. ..... 336/65; 336/205; 336/208; 336/229

[58] Field of Search ..... 336/65, 67, 68, 19 L, 336/198, 208, 229, 100, 96, 205

[56] References Cited

U.S. PATENT DOCUMENTS

| | | | |
|---|---|---|---|
| 1,634,923 | 7/1927 | Thullen | 336/65 X |
| 2,744,204 | 5/1956 | McGuiness | 336/96 X |
| 2,823,362 | 2/1958 | Geroulo et al. | 336/229 X |
| 2,899,631 | 8/1959 | Cushman | 336/96 X |
| 2,920,297 | 1/1960 | Spicer | 336/96 X |
| 2,953,758 | 9/1960 | Stanwyck | 336/65 |
| 3,068,381 | 12/1962 | Vazquez | 336/229 X |
| 3,179,908 | 4/1965 | Peabody | 336/229 X |
| 3,210,701 | 10/1965 | Fastner et al. | 336/96 |
| 3,237,137 | 2/1966 | Flaminio | 336/229 X |
| 3,339,013 | 8/1967 | Gainer et al. | 336/96 X |
| 3,343,113 | 9/1967 | Dougall | 336/208 X |
| 3,443,257 | 5/1969 | Mollman | 336/68 X |
| 3,551,864 | 12/1970 | Sweeney et al. | 336/83 |
| 3,584,823 | 6/1971 | Andrew | 336/65 X |
| 3,905,000 | 9/1975 | Walter | 336/65 |
| 3,949,338 | 4/1976 | Burson | 336/92 |
| 4,054,856 | 10/1977 | Linscott, Jr. | 336/84 |
| 4,267,404 | 5/1981 | Rohde | 336/196 X |

FOREIGN PATENT DOCUMENTS

| | | |
|---|---|---|
| 1236643 | 7/1963 | Fed. Rep. of Germany . |
| 2260269 | 7/1975 | France . |

*Primary Examiner*—Thomas J. Kozma

*Attorney, Agent, or Firm*—Hill, Van Santen, Steadman & Simpson

[57] ABSTRACT

A holding device for wound toroidal cores is formed of a carrier plate and a centering arbor extending from the carrier plate into the inside of the wound core. The wound core is fixed in place on the arbor by a casting compound.

2 Claims, 3 Drawing Sheets

HOLDING DEVICE FOR TOROIDAL CORES PROVIDED WITH WINDINGS

This is a continuation, of application Ser. No. 763,890, filed Aug. 5, 1985, now abandoned, which is continuation of application Ser. No. 482,491, filed Apr. 6, 1983, now abandoned.

BACKGROUND OF THE INVENTION

The present invention relates to a holding device for toroidal cores provided with windings.

Toroidal cores provided with windings such as, for example, toroidal core transformers, toroidal core chokes, or even simple potentiometers on occasion are not easy to secure in conjunction with other circuit elements. This is true on the one hand because they are relatively heavy and, on the other hand, they do not allow a direct, mechanical fastening since the toroidal core which is stable per se is completely surrounded by a winding, in many plies in certain applications, so that a mounting would have to engage at the winding. Accordingly, the toroidal core must be very rigidly secured and with an absolutely fixed location relative to other components since the winding ends must be connected to other stationary parts, and generally need to be soldered. Any relative motion between these parts would necessarily lead to damage.

It is known to fix toroidal cores in a special housing, to fix them either individually or together with other components such as for example further toroidal cores provided with windings, and to encapsulate the entire housing such that a unit consisting of a toroidal core and housing is created. The terminal lugs for the windings are then secured to the solder terminals, solder pins, etc. secured to the housing wall or secured to housing parts rigidly connected to the housing wall.

For the purpose of fastening toroidal cores provided with windings to circuit parts or the like where no housing can be provided, the toroidal core is generally clamped between two plates provided with an elastic layer on a side of the plates facing toward the toroidal core. The plates or a pin which is passed through the plates and simultaneously clamps the plates are secured to the corresponding device or to the circuit parts. This manner of fastening enables the toroidal core to be secured in stationary fashion to further circuit parts, for example to printed circuit boards or the like. In consideration of the existing weight of the toroidal core itself, however, the plates must be clamped relatively tightly against one another. This has a disadvantageous effect by way of a correspondingly high pressure on the winding of the toroidal core itself. Damage to the lacquer insulation of the individual windings occurs relatively easily. This is true because the mount is also exposed to relatively great temperature fluctuations.

SUMMARY OF THE INVENTION

An object of the invention is to specify a holding device for toroidal cores provided with windings which is simple in structure, which enables the direct fastening of the toroidal cores to any desired holding devices, printed circuit boards, etc., and which is designed such that the toroidal core is held practically pressure-free.

Further, the holding device should be suitable for the direct attachment of terminal pins, solder terminals, etc. in order to permit fastening of the toroidal cores to printed circuit boards or the like (so-called printed circuit fastening).

According to the invention, a holding device for a wound toroidal core has a carrier plate and a centering arbor extending from the carrier plate and into an inside of the core. The core is held by a casting compound on the centering arbor. The carrier plate preferably has a diameter at least as large as an outside diameter of the wound toroidal core.

The holding device of the invention is comprised of a carrier plate matched to the diameter of the wound toroidal core and is provided with a centering arbor penetrating the interior space of the toroidal core. The toroidal core itself is held on the retaining plate by means of a casting compound.

The teaching according to the invention to match the carrier plate to the outside diameter of the wound toroidal core first means that the plate should not have a smaller diameter than the wound toroidal core in order to avoid mechanical damage to the outside of the winding.

According to an advantageous further development of the invention, the carrier plate itself is employed as a mount for terminals such as solder pins, solder terminals or the like. The diameter must be matched to the outside diameter of the toroidal core such that a corresponding, projecting edge remains to which the terminal lugs are attached, for example in injected fashion, or on the other hand, by insertion in openings provided therefor.

In any case, the wound toroidal core thus provided with a carrier plate can be directly secured such as in screwed fashion to the corresponding devices or printed circuit boards over an opening in the centering arbor. In order to simplify the fastening work step, it is recommended according t another advantageous development of the invention to embed a retaining part provided with a thread in the carrier plate such as a hexagonal nut. This retaining part is preferably in the center of the carrier plate so that, given employment of a threaded bolt, the carrier plate can be directly fastened.

In order to guarantee a faultless seating of the carrier plate on the device part or on the printed circuit, and to provide protection against twisting when fastening the carrier plate, the carrier plate is provided with supports at its outside facing away from the toroidal core. The supports are preferably in the form of small supporting feet. The supports can, of course, also be designed in the form of radial stays, etc. into which retaining parts with a retaining thread (simple hexagonal nuts) can likewise be introduced.

DESCRIPTION OF THE PREFERRED EMBODIMENTS

Figure 1:
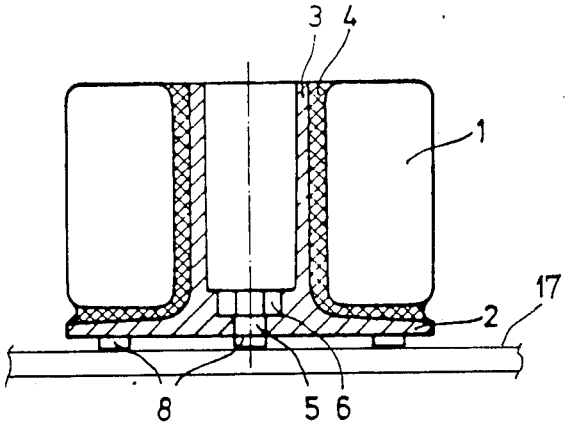
FIG. 1 is an elevational view of the holding device according to the invention.

An elevational view in section of a holding device according to the invention with a wound toroidal core 1 secured thereto is shown in FIG. 1. The holding device is comprised of a carrier plate 2 which merges into a centering arbor in the area of the inside recess of the wound toroidal core 1. The centering arbor, as can be seen from the drawing, is designed as a hollow cylinder.

The wound toroidal core 1 is put in place on the unit comprised of carrier plate 2 and centering arbor 3, and is secured and held by means of a casting compound 4.

In its center, the carrier plate 2 has a bore 5 which enables access of a bolt or the like to an embedded hexagonal nut 6. Thus, the holding device designed in such manner can, for example, be screwed from below onto a planar or perpendicular carrier plate or surface 17 by means of a simple bolt without special tools being required for this purpose.

In order, particularly during screwing, to avoid a twisting of the carrier plate 2 and the wound toroidal core 1, and to also guarantee good seating of the carrier plate, support feet 8 are provided at the bottom side of the carrier plate 2.

Figure 2:
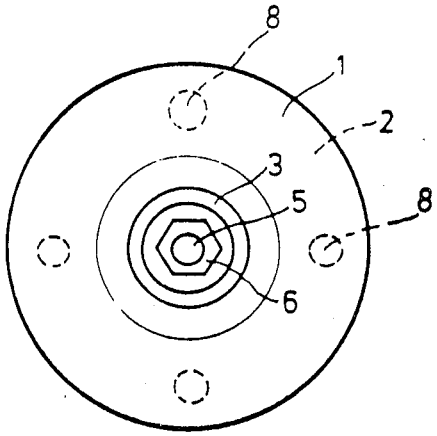
FIG. 2 is a plan view of the holding device according to FIG. 1 with the toroidal core removed.

In a plan view, FIG. 2 shows the design of the holding device according to FIG. 1, whereby the wound toroidal core is removed. It can be observed from FIG. 2 that a total of four support feet are provided.

Figure 3:
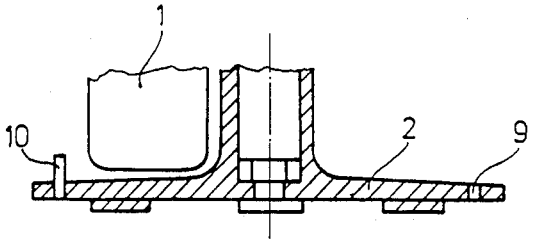
FIG. 3 is a partial sectional illustration along the section line III—III of FIG. 4 of a retaining plate for use given printed circuit fastening.
Figure 4:
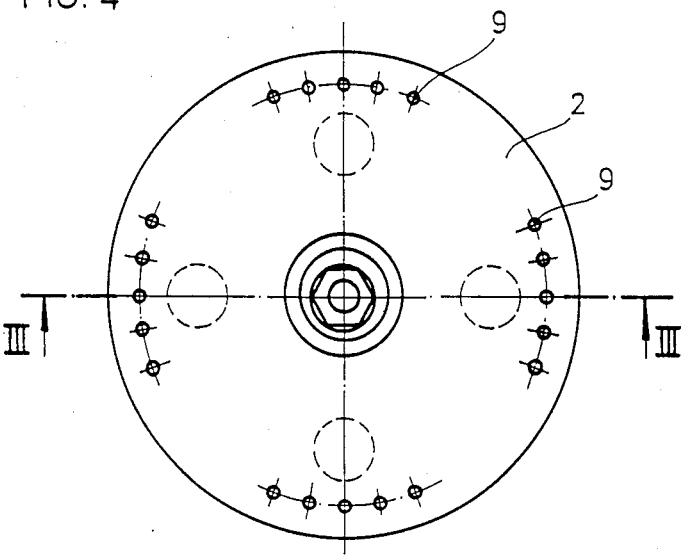
FIG. 4 is the corresponding plan view of the carrier plate of FIG. 3.

FIG. 3 is a sectional illustration and FIG. 4 is a plan view showing another embodiment of the holding device according to the invention. Given this embodiment, bores 9 are provided close to the periphery of the carrier plate 2, and solder pins 10 are insertable as needed into bores 9. The lead wires of the winding or windings of the toroidal core as well as the wiring of further components or modules run to the solder pins 10.

Given employment of an embodiment according to FIGS. 3 and 4, a carrier plate 2 is selected having a diameter which is of such size that the solder pins which may be employed come to lie outside of the area taken up by a wound toroidal core coil.

For the remainder of the device the structure of the overall holding device is analogous to the structure as explained on the basis of FIGS. 1 and 2.

For a person skilled in this art, a series of modifications in addition to the modifications already mentioned may be provided. Thus, it is entirely possible to provide retaining lugs or hexagons, nuts, the heads of bolts, or the like in the area of the support feet in order to secure the holding device equipped with the toroidal core to a device, to a printed circuit board, or the like.

Figure 5:
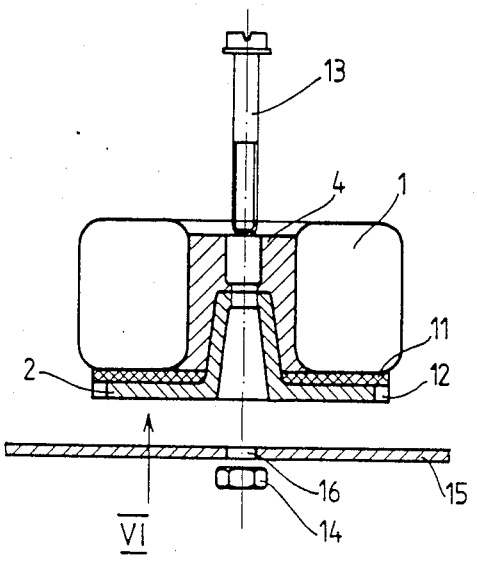
FIG. 5 is a sectional illustration of a modified embodiment of a holding device according to the invention with fastening parts for fastening the holding device to a housing wall.

A modified embodiment of the holding device is shown in sectional elevation in FIG. 5. Given this technique, a supporting medium between the core and upper face of plate 2 is a ring 11 rather than casting compound as in FIG. 1 and is formed of elastic material is provided on that side of the plate 2 facing the wound toroidal core 1. This technique is particularly advantageous when the carrier plate is relatively stiff and the surface of the windings on the toroidal core is uneven. A uniform seating pressure is thereby provided.

It is also shown in FIG. 5 how a core held according to the invention can be secured, for example in screwed fashion, to a housing wall 15. A bore 16 is provided in the housing wall through which a bolt 13 guided from the top through the centering arbor is inserted, a retaining nut 14 being screwed thereto from below.

Figure 6:
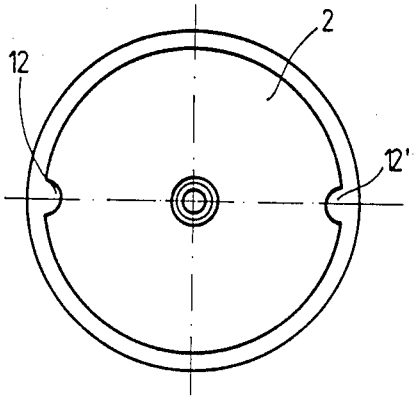
FIG. 6 is a bottom view of the retaining plate in the direction corresponding to the arrow VI in FIG. 5.

In order to prevent twisting of the toroidal core applied to the retaining plate 2 relative to the housing wall during assembly as well, recesses 12 or 12' are provided in the retaining plate 2 given this embodiment. The recesses are brought into engagement with retaining dogs or retaining projections (not illustrated in the FIGURE) at the housing wall. A view of a retaining plate with such recesses 12 or 12', is shown in FIG. 6, the view being taken along the arrow VI in FIG. 5.

The carrier plate with the centering arbor is preferably fabricated of a castable synthetic, particularly with a polystyrol modified with butadiene and acrylonitrile as commercially available, for example, under the trade name Terluran. It is preferred, given toroidal cores having a very large iron core, to co-impress reinforcing inserts of fiberglass or carbon fibers, etc., in order to give the carrier a stability corresponding to the respective given conditions. A reinforcement is recommended, for example, when the holding device is particularly stressed by jolts from other influences given employment on vehicles, etc.

Although various changes and modifications might be proposed by those skilled in the art, it will be understood that I wish to include within the claims of the patent warranted hereon all such changes and modifications as reasonably come within my contribution to the art.

I claim as my intention:

1. A toroidal core system wherein a toroidal core provided with a winding is held in fixed position to a planar carrier surface member without use of a housing surrounding the core and winding, comprising:

a toroidal core with a winding thereon and a central aperture;

a planar carrier surface member;

a holding device in the form of a circular carrier plate in abutment with and mounted with system mounting hardware to the planar carrier surface member and which is not part of a housing laterally surrounding the core or covering a top of the core opposite the carrier plate, the carrier plate having a diameter at least as large as an outside diameter of the wound toroidal core so as to protect the winding on the core and for support of the core without use of a housing, a substantially circular centering arbor of one piece construction with the carrier plate extending from the carrier plate and into an inside of the central aperture but not in contact with the core, and the holding device having a central aperture means for receiving said system mounting hardware therethrough for rigidly fastening the holding device to the planar carrier surface member;

the core being centered on the centering arbor and spaced from the carrier plate such that no part of the core and winding touches any part of the holding device; and a casting compound between the core and centering arbor in the central aperture and between the core and the carrier plate attaching and supporting the core to the holding device, whereby the toroidal core is mounted without damage to its winding and is also protected from the surrounding environment.

2. A toroidal core system wherein a toroidal core provided with a winding is held in fixed position to a planar carrier surface member without use of a housing surrounding the core and winding, comprising:

a toroidal core with a winding thereon and a central aperture;

a planar carrier surface member a holding device in the form of a circular carrier plate in abutment with and mounted with system mounting hardware to the planar carrier surface member and which is not part of a housing laterally surrounding the core or covering a top of the core opposite the carrier plate, the carrier plate having a diameter at least as large as an outside diameter of the wound toroidal core so as to protect the winding on the core and for support of the core without use of a housing, a substantially circular centering arbor of one piece construction with the carrier plate extending from the carrier plate and into an inside of the central aperture but not in contact with the core, and the holding device having a central aperture means for receiving said system mounting hardware therethrough for rididly fastening the holding device to the planar carrier surface member;

the core being centered on the centering arbor and spaced from the carrier plate such that no part of the core and winding touches any part of the holding device; and a casting compound between the core and centering arbor in the central aperture and between the core and the carrier plate attaching and supporting the core to the holding device, and an elastic material ring between the core and the carrier plate supporting the core, whereby the toroidal core is mounted without damage to its winding and is also protected from the surrounding environment.

* * * * *